US005109217A

United States Patent [19]

Siikarla et al.

[11] Patent Number: 5,109,217

[45] Date of Patent: * Apr. 28, 1992

[54] METHOD AND APPARATUS FOR ENHANCING DETECTION OF ELECTRONIC ARTICLE SURVEILLANCE TAGS IN CLOSE PROXIMITY TO ELECTRICALLY CONDUCTIVE OBJECTS

[75] Inventors: Risto Siikarla, Boca Raton; Douglas A. Narlow, Coral Springs, both of Fla.

[73] Assignee: Sensormatic Electronics Corporation, Deerfield Beach, Fla.

[ * ] Notice: The portion of the term of this patent subsequent to Jul. 9, 2008 has been disclaimed.

[21] Appl. No.: 565,369

[22] Filed: Aug. 9, 1990

[51] Int. Cl.[5] ..... G08B 13/14; H01Q 1/36

[52] U.S. Cl. ..... 340/572; 343/895

[58] Field of Search ..... 340/572; 343/894–895; 342/42, 44

[56] References Cited

U.S. PATENT DOCUMENTS

| | | | |
|---|---|---|---|
| 3,895,368 | 7/1975 | Gordon et al. | 340/572 |
| 4,139,844 | 2/1979 | Reeder | 340/572 |
| 4,642,640 | 2/1987 | Woolsey et al. | 342/42 |
| 4,736,207 | 4/1988 | Siikarla et al. | 343/895 |
| 4,866,424 | 9/1989 | Parks | 340/572 X |
| 5,030,940 | 7/1991 | Siikarla | 340/572 |

*Primary Examiner*—Glen R. Swann, III
*Assistant Examiner*—Thomas J. Mullen, Jr.
*Attorney, Agent, or Firm*—Robin, Blecker, Daley & Driscoll

[57] ABSTRACT

A method for detection of EAS tags in a surveillance area into which an electrostatic field is propagated and in which an electronically conductive object is present, includes a step of providing a tag reradiator configuration which is unaffected by close proximity to the object. The step is practiced by configuring the tag reradiator as a first part of a monopole, the object being used as a further part of the monopole, and by disposing the first monopole part beyond the outside perimeter of the conductive environment. The tag reradiator is further configured to define a part of a dipole, the object being used as a further part of the dipole. In an alternative practice, the tag reradiator includes a ground plane member and itself defines such monopole and dipole. In the former practice, the tag reradiator is electrically connected with the object. In the latter practice, the tag reradiator is affixed to the object in electrical isolation therefrom.

20 Claims, 3 Drawing Sheets

METHOD AND APPARATUS FOR ENHANCING DETECTION OF ELECTRONIC ARTICLE SURVEILLANCE TAGS IN CLOSE PROXIMITY TO ELECTRICALLY CONDUCTIVE OBJECTS

FIELD OF THE INVENTION

This invention relates generally to the field of electronic article surveillance (EAS) and pertains more particularly to method and apparatus for enhanced detection of EAS tags which are in close proximity to electrically conductive objects and subjected to electrostatic fields for tag detection.

BACKGROUND OF THE INVENTION

In an electronic article surveillance (EAS) system of known type, a transmitter-receiver arrangement is disposed aside an area to be controlled and transmits a first high-frequency signal into the area. A separate transmitter furnishes a second signal of substantially lower frequency (commonly referred to as the E-field or electrostatic field signal). Reradiators, typically comprising a dipole and a nonlinear element, are responsive to the incidence thereon of both transmitted signals to transmit a composite thereof and detection of such composite signal in receiving apparatus indicates the presence of the reradiator (security tag) in the controlled area. Such system is further described in U.S. Pat. Nos. 3,895,368 and 4,139,844, commonly-assigned herewith and incorporated herein by this reference.

Conductive objects create a problem for security tags which make use of electrostatic energy for detection. Because electrostatic fields present extremely high driving-point impedances to circuit elements, any conductive object creates a short circuit path. Consequently, circuit elements are at equal electrostatic potential, and no resulting voltage can exist between any two points in such an environment.

Virtually all electronic circuits in common practice are comprised of components that are essentially low-impedance or near short circuits to electrostatic fields. In the typical security tag above described, voltage differential across the nonlinear circuit element, which may be a diode, is essential to generation of the composite signal to be reradiated. Evidently, signal generation would be thwarted by the equal electrostatic potential which would be imposed thereon by a conductive object in close proximity to the tag.

In order to minimize the short-circuit effects of conductive objects, electrostatically driven high-frequency tags heretofore have been required to be placed remotely from the objects, which greatly increases the thickness requirement of such a combination of tag and object.

SUMMARY OF THE INVENTION

The present invention has as its object the provision of a solution to the foregoing difficulty confronting EAS systems relying on electrostatic fields for security tag detection.

In attaining this and other objects, the invention provides, in a method for detection of EAS tags in a surveillance area into which an electrostatic field is propagated and in which electrically conductive objects are present, and have the effect of causing degradation of the detection of the EAS tags, the step of providing a tag reradiator configuration which is unaffected by close proximity to the objects.

Tag reradiators heretofore used in EAS systems of the type described above have been of dipole configuration, as in commonly-owned U.S. Pat. Nos. 4,642,640 and U.S. Pat. No. 4,736,207, which are incorporated herein by this reference. In accordance with the subject invention, however, the tag reradiator is configured further as a monopole, the monopole either using the conductive object as its ground plane, in which case electrical connection exists to the object, or using a separate ground plane as a component of the monopole.

Per the invention, the monopole is disposed beyond the outside perimeter i.e., a boundary, of the electrically conductive environment. With such additive monopole configuration and placement, it is found that short-circuiting does not occur responsively to the electrostatic field. Further, the reradiator need not be spaced considerably from the object, thus overcoming the prior art disadvantage above discussed.

The foregoing and other objects and features of the invention will be further understood from the following detailed description thereof and from the drawings wherein like reference numerals identify like parts and components throughout.

DETAILED DESCRIPTION OF PREFERRED EMBODIMENTS AND PRACTICES

FIGS. 1-5 hereof are replicates of drawings presented in a copending, commonly-assigned U.S. patent application entitled "Electronic Article Surveillance System and Tag", filed on even date herewith.

Figure 2:
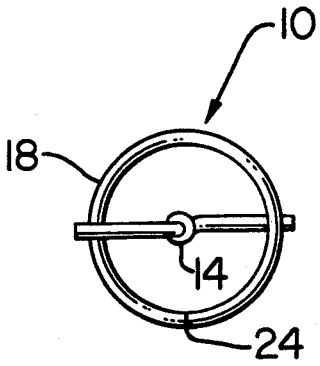
FIG. 2 is a top plan elevation of the FIG. 1 reradiator.
Figure 1:
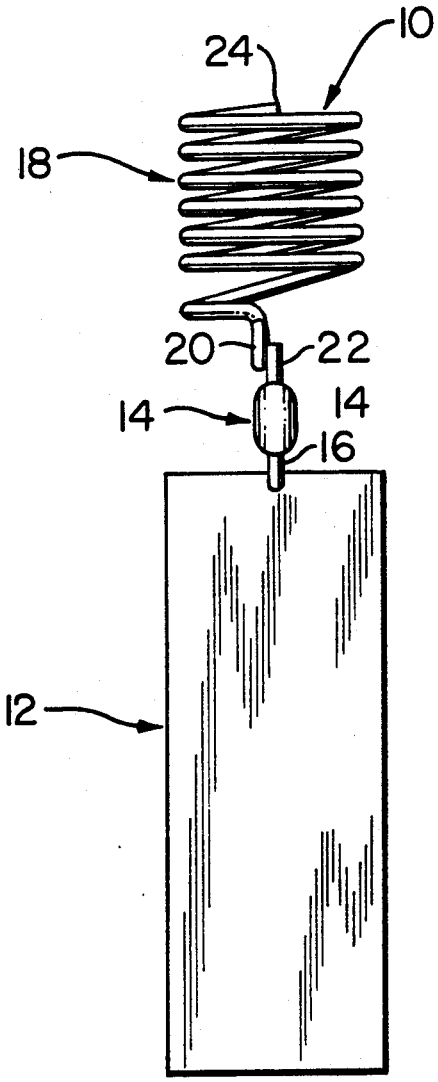
FIG. 1 is a front plan elevation of a reradiator which is explanatory of the method of the invention.
Figure 3:
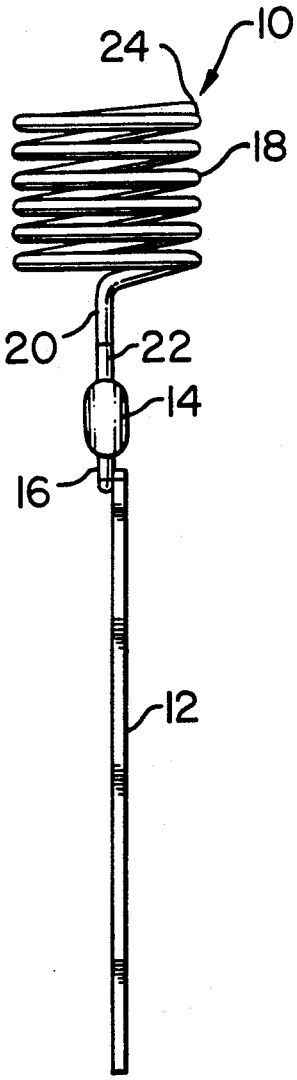
FIG. 3 is a right side elevation of the FIG. 1 reradiator.

Referring to FIGS. 1-3, reradiator 10 of the invention includes an elongate, generally planar and electrically conductive member 12, constituting the ground plane of the reradiator.

A nonlinear element 14, typically a diode, has one lead 16 thereof connected electrically, as by solder, to ground plane 12 adjacent an end thereof.

Reradiator element 18 has one end 20 thereof electrically connected to a second lead 22 of diode 14 and its other end 24 is without electrical connection thereto.

Ground plane 12 is typically a rectangular section of a conductive sheet, the dimensions of which are selected to minimize the overall size of the tag, yet maintaining the minimum required performance in a particular application. The optimum width to minimize the overall tag size is the same as the outside diameter of the spiral reradiator element.

Diode 14 is preferably a semiconductor diode, having high and low frequency characteristics selected desirably as described in the referenced '207 patent.

Reradiator element 18 is preferably a spiral inductor of dimensions selected to optimize the impedance match to cumulative impedance conditions presented by the inductor to the other two components, all such three components being connected electrically as a series circuit.

The function of reradiator element 18 is three-fold, namely, to receive and transmit high frequency energy, to serve as one side of an elementary dipole to capture low frequency electrostatic energy, typically 100 kHz, and to provide impedance matching at high frequency among the three components connected in series.

The function of diode 14 is that disclosed in the '207 patent, namely, to generate high frequency sidebands through reactance-modulation by applied low frequency electrostatic energy.

The function of ground plane 12 is two-fold, namely, to serve as the ground against which reradiator element 18 forms a monopole antenna and to serve as the second part of a dipole for low frequency electrostatic energy, as in the prior art endeavors described above.

Figure 4:
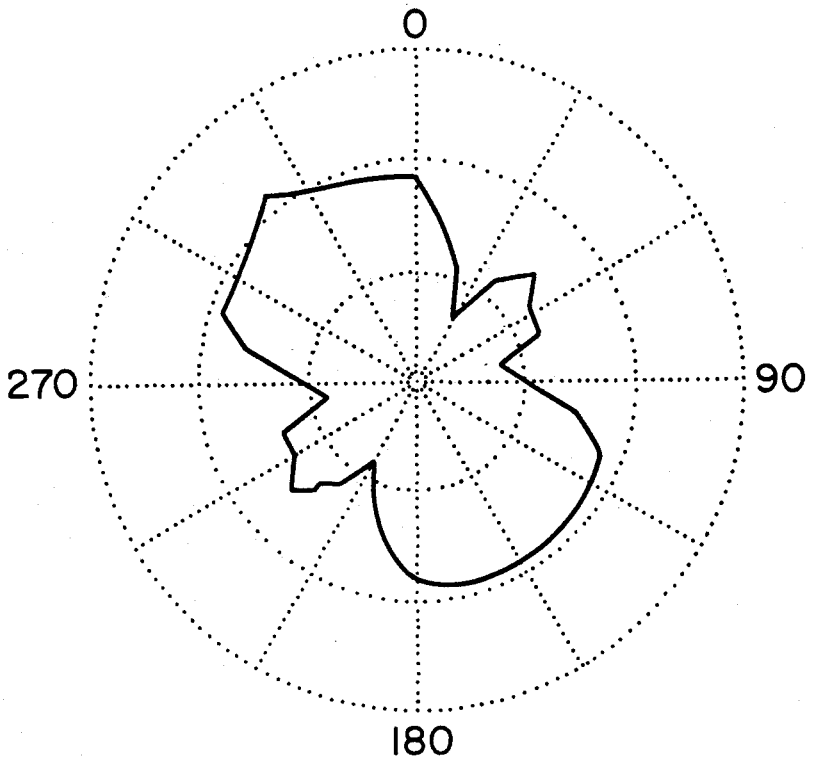
FIG. 4 is a polar plot of the performance characteristics of a prior art reradiator.
Figure 5:
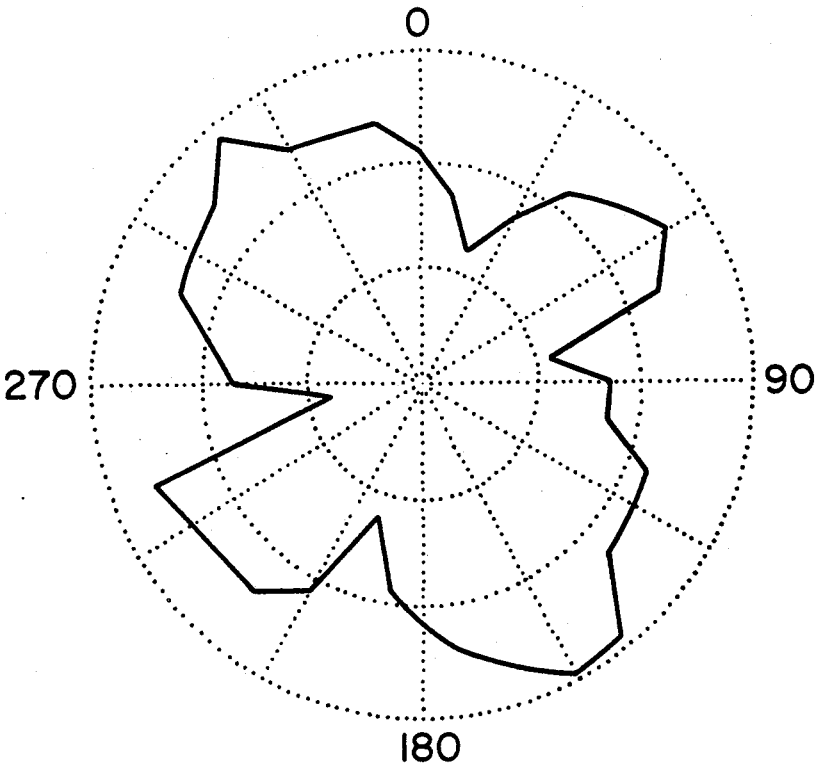
FIG. 5 is a polar plot of the performance characteristics of the FIG. 1 reradiator constructed in accordance with the invention.

Reference is now made to the plots of FIGS. 4 and 5. An evaluation method involves polar plotting of the distance at which a tag response (reradiation) is sensed with respect to a source transmitting-receiving location. The graphics programs show the response in the form of a polar diagram, where each circle represents a distance of ten inches. The full scale is of thirty inches and plots the response at 10 degree increments and computes a total for the readings, from which it computes an estimated pick rate. Computation is based on tag performance in a reference system installation used for correlation between standard test results and actual system pick rate.

For comparison, a standard assignee product, the EL90 Microgator tag, is measured. The sample is verified to meet the quality standards for the product.

FIG. 4 shows the response of the reference tag EL90, and FIG. 5 presents the results obtained from a tag constructed as in the case of FIGS. 1-3. Estimated performance improvement of thirty-two percent is seen as being obtained by the invention, despite the smaller size of the tag of the invention. The EL90 tag dimensions are 0.75" wide and 2.45" long, or 1.84 square inches of cross section area. The sample of the invention disclosed here measured 0.375" wide and 1.8" long, which equals 0.675 square inch total area, or a sixty-three percent reduction in size.

Figure 6:
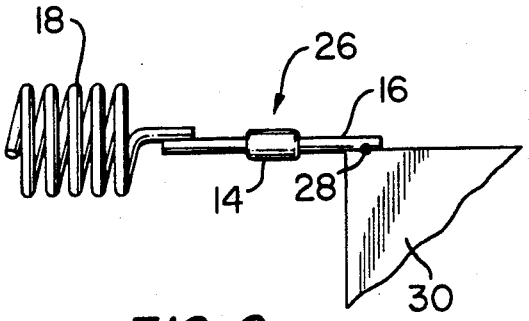
FIG. 6 is a side elevation of a first embodiment of apparatus and practice in accordance with the invention affixed with electrical connection to a conductive object partially shown.

Turning to FIG. 6, which is a side elevation of a first embodiment of apparatus 26 in accordance with the invention, spiral reradiator element 18 and diode 14 are connected as above described, but without ground plane member 12. Lead 16 of diode 14 is electrically connected, as by solder 28, to conductive object 30. In this instance, reradiator element 18 and diode 14 are both disposed outside of the perimeter of conductive object 30, which functions as the ground plane member of the apparatus. The functioning of apparatus 26 in conjunction with object 30 is fully that of the apparatus of FIGS. 1-3 and the aforementioned performance characteristics apply equally, thus thwarting the customary influence of the conductive object in creating electrical short-circuiting of components required for EAS purposes.

Figure 7:
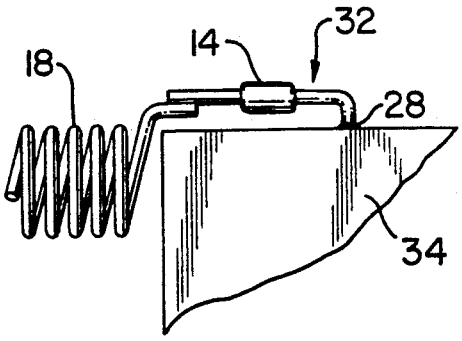
FIG. 7 is a side elevation of a second embodiment of apparatus and practice in accordance with the invention affixed with electrical connection to a conductive object partially shown.

Turning to FIG. 7, which is a side elevation of a second embodiment of apparatus 32 in accordance with the invention, spiral reradiator element 18 and diode 14 are connected as above described, again without ground plane member 12. The FIG. 7 arrangement will be seen to obtain further foreshortening of the length of the reradiator. Thus, whereas in the embodiment of FIG. 6, the diode was not in locational co-registration with the conductive object, the arrangement of FIG. 7 depicts locational registry of the diode and conductive object 34, i.e., the diode and object 34 are in confronting mutual relation, with reradiator element 18 being longitudinally successive to both of the diode and the conductive object. The functioning of apparatus 32 in conjunction with object 34 is fully that of the apparatus of FIGS. 1-3 and the aforementioned performance characteristics apply equally, thus thwarting the customary influence of the conductive object in creating electrical short-circuiting of components required for EAS purposes.

Figure 9:
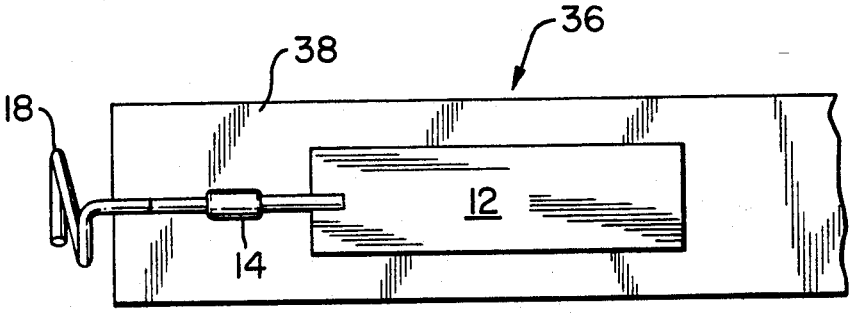
Figure 8:
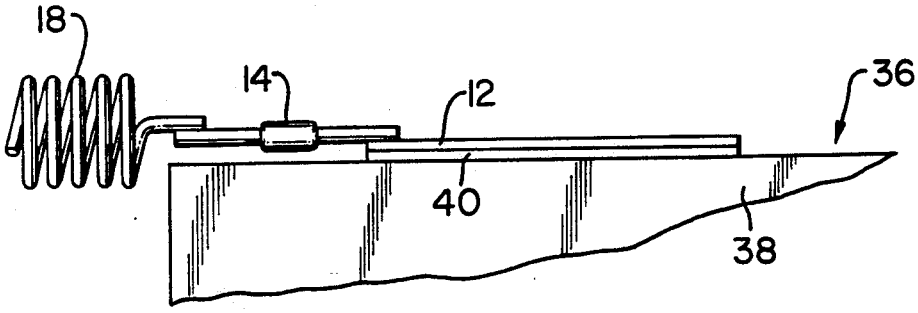
FIGS. 8 an 9 are respective side and plan elevations of a third embodiment of apparatus and practice in accordance with the invention affixed to a conductive object partially shown, however, without need for electrical connection thereto.

FIGS. 8 and 9 are respective side and plan elevations of a third embodiment of apparatus 3 in accordance with the invention affixed to a conductive object 38 partially shown, however, without need for electrical connection thereto. In this instance, apparatus 36 is inclusive of reradiator element 18, diode 14 and ground plane member 12, the latter being electrically isolated from object 38, for example, as by adhesive layer 40. Since this last described practice involves the use of the reradiator of FIGS. 1-3, its performance is that discussed in conjunction with FIGS. 4 and 5 above noted.

Various changes to structure and practice may be introduced in the foregoing embodiments and methods without departing from the invention. Thus, the particularly discussed and depicted embodiments and methodology are intended in an illustrative and not in a limiting sense. The true spirit and scope of the invention is set forth in the following claims.

What is claimed is:

1. In a method for detection of EAS tags in a surveillance area into which an electrostatic field is propagated and in which an electrically conductive object is present, the step of providing a tag reradiator configuration which is unaffected by close proximity to said object.

2. The invention claimed in claim 1 wherein said step is practiced by configuring said tag reradiator as a first part of a monopole, said object being used as a further part of said monopole, and wherein said first part of said monopole is disposed beyond a boundary of said object.

3. The invention claimed in claim 2 wherein said tag reradiator is electrically connected to said object.

4. The invention claimed in claim 2 wherein said tag reradiator is further configured to define a part of a dipole, said object being used as a further part of said dipole.

5. The invention claimed in claim 1 wherein said tag reradiator is configured with:

(a) a reradiator element; and (b) a nonlinear element connected electrically to said reradiator element and to said object, said reradiator element, said nonlinear element and said object being in electrical series circuit connection, said reradiator element and said object defining a monopole antenna responsive to incidence on said tag of high frequency energy for reradiation of said high frequency energy.

6. The invention claimed in claim 5 wherein said reradiator element and said object further define a dipole antenna responsive to incidence on said tag of energy of frequency substantially lower than said high frequency energy

7. The invention claimed in claim 6 wherein said nonlinear element is selected so as to generate high frequency sidebands through reactance-modulation by such lower frequency energy.

8. The invention claimed in claim 5 wherein said reradiator element is configured as a spiral inductor.

9. The invention claimed in claim 5 wherein said tag is configured to be elongate, with said reradiator having a central axis longitudinally disposed with said tag, said nonlinear element being disposed in general alignment with said central axis, said reradiator element and said nonlinear element being disposed generally exteriorly of a boundary of said object.

10. The invention claimed in claim 1 wherein said step is practiced by configuring said tag reradiator as a monopole.

11. The invention claimed in claim 10 wherein said tag reradiator is electrically insulated with respect to said object.

12. The invention claimed in claim 10 wherein said tag reradiator is further configured to define a dipole.

13. The invention claimed in claim 10 wherein said tag reradiator is configured with:

(a) a reradiator element;

(b) a nonlinear element connected electrically to said reradiator element; and (c) an electrical ground plane member connected electrically to said nonlinear element, said reradiator element, said nonlinear element and said ground plane member being in electrical series circuit connection, said reradiator element and said ground plane member defining a monopole antenna responsive to incidence on said tag of high frequency energy for reradiation of said high frequency energy.

14. The invention claimed in claim 13 wherein said reradiator element and said ground plane member further define a dipole antenna responsive to incidence on said tag of energy of frequency substantially lower than said high frequency energy.

15. The invention claimed in claim 13 wherein said nonlinear element is selected so as to generate high frequency sidebands through reactance-modulation by such lower frequency energy.

16. The invention claimed in claim 15 wherein said nonlinear element is a diode.

17. The invention claimed in claim 13 wherein said reradiator element is configured as a spiral inductor.

18. The invention claimed in claim 17 wherein said spiral inductor is of dimensions selected to effect an impedance match to cumulative impedance conditions presented by the inductor to the said nonlinear element and said ground plane member.

19. The invention claimed in claim 13 wherein said tag is elongate, said reradiator having a central axis longitudinally disposed with said tag, said nonlinear element and said ground plane member being disposed with at least respective parts thereof in mutual registry longitudinally of said tag.

20. The invention claimed in claim 13 wherein said ground plane member is a conductive sheet.

* * * * *